United States Patent [19]

Lee

[11] 4,226,101

[45] Oct. 7, 1980

[54] CABINET LOCK WITH FRANGIBLE COVER PLATE AND PUSH BUTTON LOCK RELEASE AND ALTERNATIVE KEY RELEASE

[76] Inventor: Walter F. Lee, 250 Paisley La., Minneapolis, Minn. 55422

[21] Appl. No.: 965,924

[22] Filed: Dec. 4, 1978

[51] Int. Cl.[2] ..... E05B 65/44; E05B 63/00; E05C 3/02

[52] U.S. Cl. ..... 70/78; 70/141; 70/465; 292/92; 292/229; 292/DIG. 65

[58] Field of Search ..... 70/78, 84, 91, 92, 141, 70/465, 394, 101, 135, 139; 292/92, 21, 229, DIG. 37, DIG. 65

[56] References Cited

U.S. PATENT DOCUMENTS

| | | | |
|---|---|---|---|
| 1,136,141 | 4/1915 | Kelley | 70/465 X |
| 1,253,545 | 1/1918 | Tompkins et al. | 292/229 X |
| 1,263,358 | 4/1918 | Anderson | 292/229 X |
| 2,473,205 | 6/1949 | Jazwieck | 70/465 X |

*Primary Examiner*—William E. Lyddane
*Attorney, Agent, or Firm*—Wicks & Nemer

[57] ABSTRACT

A cabinet lock which includes a housing having a latch mounted in the housing for pivotal movement into and out of the housing together with a push plate slidably mounted in the housing for releasing the lock. The latch has a slot formed therein and a first spring urges the push plate away from the latch whereby a lug on the push plate engages the slot of the latch which prevents the latch from pivoting from a position extending outwardly of the lock. A second spring connected to the latch and the housing urges the latch inwardly of the housing when the lug of the push plate is removed from the slot of the latch as the push plate is pushed inwardly of the housing against the action of the first spring.

The housing carries a frangible plate covering the push plate which may be broken whereby the push plate may be pushed.

The latch is pivotally secured in a position extending outwardly of the housing when the push plate is released and is urged away from the latch thereby engaging the lug of the push plate into the slot of the latch. The push plate may also be pushed by means of a key insertable into the housing under the frangible plate.

7 Claims, 15 Drawing Figures

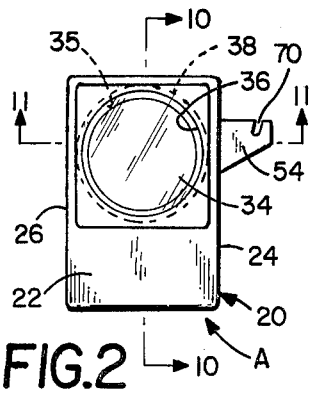
FIG.2
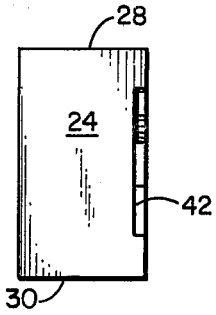
FIG.3
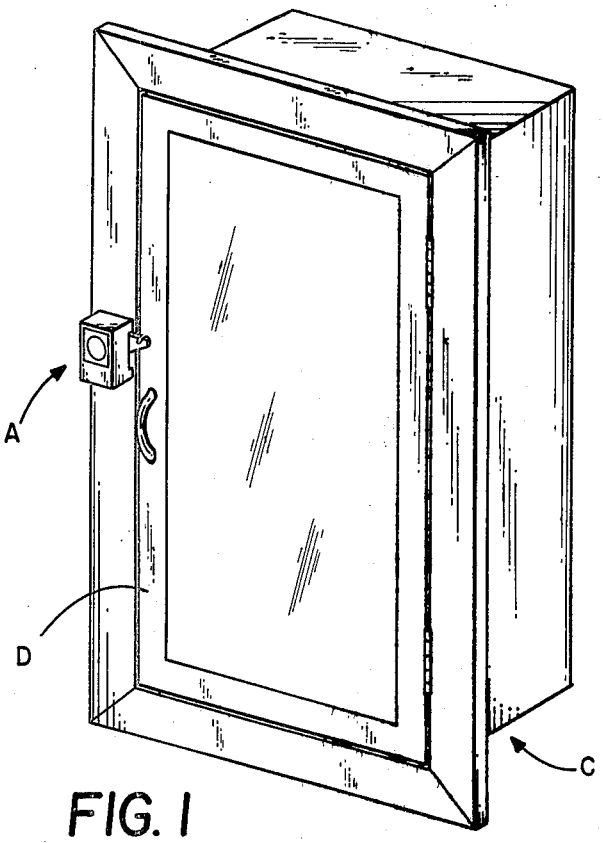
FIG. 1
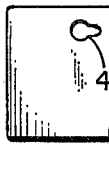
FIG. 4
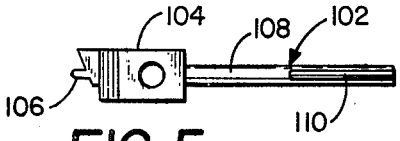
FIG. 5
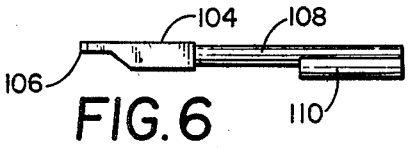
FIG. 6
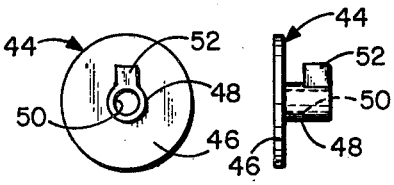
FIG. 8 FIG. 9
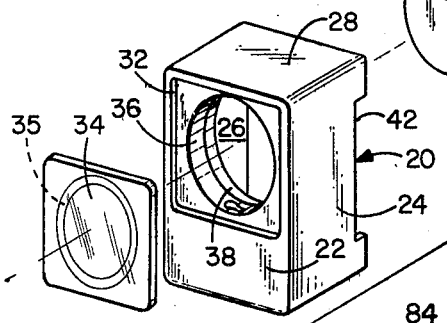
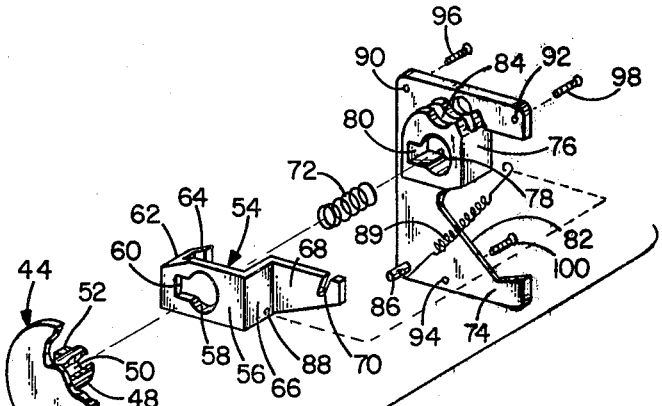
FIG. 7
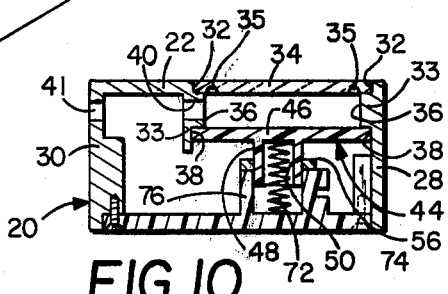
FIG. 10
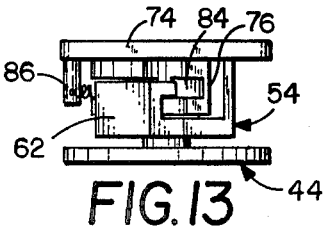
FIG. 13
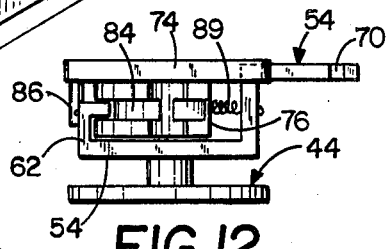
FIG. 12
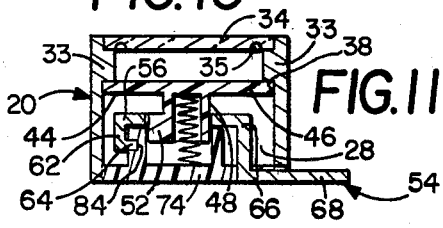
FIG. 11

CABINET LOCK WITH FRANGIBLE COVER PLATE AND PUSH BUTTON LOCK RELEASE AND ALTERNATIVE KEY RELEASE

SUMMARY

The invention herein disclosed relates broadly to an improvement in a lock for a cabinet for such items as, a fire extinguisher, tools, drugs, telephone, liquor, first aid and the like and more particularly to a lock which allows for opening of a locked door of a cabinet by a person requiring the contents of the cabinet but without a key for the lock. The lock is mounted on the casing of the cabinet and has a latch for engagement with the door which prevents the door from being opened. The lock includes a latch which is operable with a key or by means of breaking a frangible plate which allows access to a push plate which when pushed inwardly of the lock causes the latch to be removed from the door whereby the lock can be unlocked without the key to allow opening of the door of the cabinet.

While the cabinet can be gotten into by a thief or unauthorized person by breaking the frangible plate and pushing the push plate, the lock allows a locked cabinet but with entry for use of the contents of the cabinet in an emergency but which requires a positive act to open the cabinet by the breaking of the plate and pushing of the push plate. The lock deters vandalism but allows an opening of the cabinet in an emergency without a key.

The invention will appear more clearly from the following detailed description when taken in connection with the accompanying drawings, showing by way of example a preferred embodiment of the inventive idea wherein like numerals refer to like parts throughout.

In the drawings forming part of this application:

FIG. 1 is a perspective view of a cabinet with a lock having a frangible panel and a pressure and key release plate embodying the invention with the lock shown in locking condition for the door of the cabinet.

FIG. 2 is a front elevational view of the lock.

FIG. 3 is a side elevational view of the lock.

FIG. 4 is a bottom end view thereof.

FIG. 5 is a bottom plan view of a key for the lock.

FIG. 6 is a side elevational view of the key.

FIG. 7 is an exploded perspective view of the lock.

FIG. 8 is a rear elevational view of the pressure plate.

FIG. 9 is a side elevational view of the pressure plate.

FIG. 10 is a sectional view on the line 10—10 of FIG. 2.

FIG. 11 is a sectional view on the line 11—11 of FIG. 2.

FIG. 12 is a top end view of the mechanism of the lock in locked condition.

FIG. 13 is a view similar to FIG. 12 but with the lock in an unlocked condition.

Figure 14:
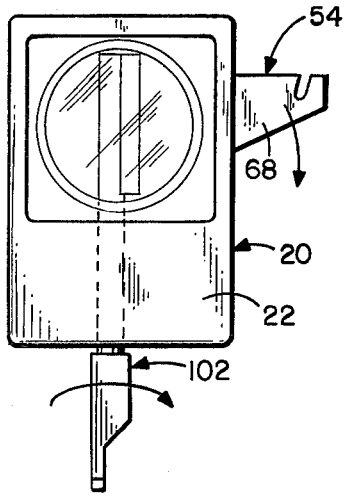
FIG. 14 is a front view of the lock with one end of the key in unlocking position in the lock with the arrows showing the direction of rotation of the key and the movement of the latch.

Referring to the drawings in detail, the lock A includes the housing 20 which includes the front wall 22, the first and second sidewalls 24 and 26, the top wall 28 and the bottom wall 30. The front surface of the front wall has formed therein the recess 32 which receives the frangible plastic or glass plate 34. The plate 34 is formed with the circular groove 35 which makes the plate frangible at the groove by exerting pressure on the plate. Extending inwardly of the recess 32 is the boss 33 in which is formed the circular opening 36 and inwardly of the circular opening and in the boss is the circular recess 38. In the lower portion of the boss 33 is the internal keyhole 40, and the sidewall 24 is formed at the rear edge with the elongated recess 42. The bottom 30 of the housing is formed with the keyhole 41.

The numeral 44 designates a lock release push plate which includes the disc portion 46 and extending axially therefrom is the cylindrical extension 48 formed with the recess 50. Extending radially from the extension 48 is the lug 52. Further provided is the latch 54 which includes the flat base portion 56 formed with the semicircular hole 58 from which extends a receiver in one form of the squared off slot 60. Extending from the outer end of the base portion 56 is the right angular arm portion 62 which terminates in the right angular lip 64 which overlies and is spaced from the flat base 56. Extending from the inner end of the flat base 56 is the right angular flange 66 which overlies the arm portion 62. The flange 66 terminates at its outer end in the latch arm 68 which is parallel to the flat base 56 and in which is formed the notch 70.

The numeral 72 designates a coil spring which is positioned in the recess 50 of the extension 48 of the release push plate 44 and as hereinafter described. A flat base member 74 is provided which closes off the open rear end of the housing 20 and which has formed thereon the bosset 76. The bosset 76 extends at a right angle to the flat base 74 and includes the semicircular hole 78 from which extends the squared off slot 80, and the axis of the semicircular hole 78 is normal to the flat base 74. The hole 78 acts as a bearing for the cylindrical extension 48 of the release push plate 44. The base 74 is also formed with the notch 82 which receives the latch arm 68 when the latch arm is in the withdrawn nonlocking position, particularly FIG. 15.

The top of the bosset 76 is formed with the slot 84 which receives the lip 64 of the latch 54 when the latch is withdrawn into the housing 20 in the unlocking condition. The recess 42 in the wall 24 of the housing allows the latch 54 to be withdrawn into the notch 82 of the flat base 74. The base 74 is provided at the lower corner edge thereof with the pin 86 which extends from the base. The flange 66 of the latch 54, particularly FIG. 7, is formed with the hole 88 with one end of the spring 89 engaged in the hole 88 and the other end on the pin 86 which urges the latch to the withdrawn unlocking position of the latch.

The base 74 is formed with the holes 90, 92 and 94 through which are positioned the screws 96, 98 and 100, respectively, and the screws engage bossets internally of the housing to thereby secure the base 74 to the open rear of the housing.

The key 102 is provided which has the base 104 from which extends the catch 106 used in resetting the lock from an unlocked condition to a locked condition. Also extending from the base in the opposite direction is the rod 108 on which is formed the elongated tooth 110 used in releasing the lock from a locking condition, as hereinafter described.

The lock A is assembled and operates in the following manner. The disc portion 46 of the release plate 44 is positioned in the recess 38 with the spring 72 positioned in the recess 50 of the extension 48. The extension 48 is then inserted through the hole 58 of the latch 54 with the lug 52 in the slot 60 of the latch. It will be seen that with the lug 52 in slot 60, the latch is held in the locking position of FIGS. 1, 2 and 11 against the urging of the spring 89 with the release plate 44 urged into the recess 38 by means of the spring 72 which maintains the lug 52 in the slot 60.

The lip 64 is positioned in the slot 84 of the bosset 76, and the spring 72 is in pressure engagement with the base 74 when the base 74 is secured in position upon the housing 20 thereby urging the release plate 44 into the recess 38 and maintaining the lug 52 in the slot 60 of the latch.

Figure 15:
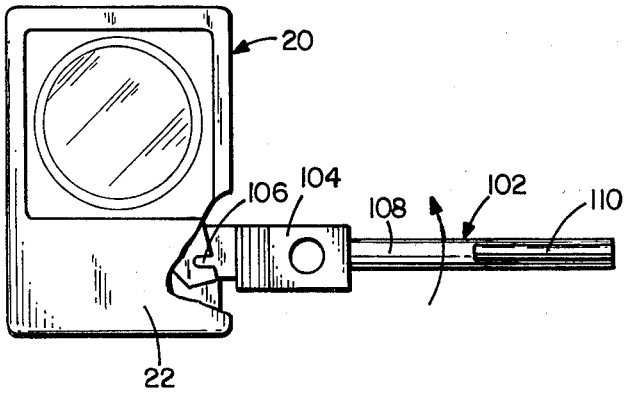
FIG. 15 is a front view of the lock with the other end of the key in connection with the latch for moving the released latch to latched position, the arrow showing the direction of movement of the key.

In an emergency, when the lock A must be opened without a key so as to open the cabinet C, the plate 34 is broken which affords access to the lock release plate 44 and with pressure applied to the disc 46 of release plate 44, the plate is moved inwardly of the housing and latch 54, and the lug 52 is forced from engagement with notch 60 of the latch into a position in the slot 80 whereby the latch is caused to pivot on the extension 48 of the release plate downwardly due to the pulling action of the spring 89 whereby the latch is in the notch 82 of the base 74 and wholly within the housing 20 in an unlocked position, see FIG. 15. As a result of the above, the door D of the cabinet can bypass the latch of the lock and be opened.

To reset the latch into the extended lock position, the catch 106 of the key is inserted into the notch 70 of the latch as in FIG. 15 and the latch pivoted upwardly against the action of the spring 89 whereby the lug 52 of pressure release plate 44 is forced into engagement with the notch 60 of the latch due to the action of the spring 72. With the lug 52 in the notch 60, the latch 54 is held in the position of FIGS. 1 through 3, and with the lock A secured to the casing of the cabinet C and the latch overlapping the door edge, the door D cannot be opened.

The lock A may be opened by use of the key 102 by inserting the rod 108 into the keyhole 41 of the housing and through the inner keyhole 40 to a point where the tooth 110 overlies the disc 46 of the release plate 44 and then rotating the key whereby the tooth 110 forces the pressure plate 44 inwardly against the spring 72 which pivots the latch 54 as hereinbefore described from the position of FIG. 14 to that of FIG. 15.

Having thus described the invention, what is claimed as new and desired to be secured by Letters Patent is:

1. A cabinet lock with frangible cover plate and lock release push plate comprising:

(a) a housing, (b) a latch having receiving means, (c) means mounting said latch for pivotal movement to a position in and out of said housing, (d) a lock releasing push plate, (e) means slidably mounting said push plate within said housing, (f) first means urging said push plate away from said latch, (g) means carried by said push plate for engagement with said receiving means of said latch for preventing said latch from pivotal movement outwardly of said housing, (h) second means urging said latch pivotally into said housing when said engagement means of said push plate is disengaged from the receiving means of said latch by means of said push plate slidably pushed inwardly of said housing, (i) a frangible plate carried by said housing and covering said push plate, and (j) said latch being pivotally secured in a position extending outwardly of the housing when said push plate is released and is urged away from said latch thereby engaging said engagement means of said push plate into said receiving means of said latch.

2. The device of claim 1 further characterized by (a) said housing having a keyhole which receives (b) a key, (c) said key having a tooth for depressing said push plate to cause said latch to be pivoted from a position extended from said housing to one with said latch within said housing.

3. The device of claim 1 in which (a) said first urging means is a spring, and (b) said second urging means is a spring.

4. The device of claim 3 in which said means slidably mounting said push plate in said housing includes (a) said push plate having an extension mounted in (b) a hole formed in a bosset carried by said housing.

5. The device of claim 1 in which said engagement means includes a lug for engagement with said receiving means of said latch.

6. The device of claim 5 in which said receiving means of said latch is a slot formed therein.

7. The device of claim 1 in which said receiving means of said latch is a slot formed therein.

* * * * *